US012601530B2

(12) United States Patent
Lin et al.

(10) Patent No.: US 12,601,530 B2
(45) Date of Patent: Apr. 14, 2026

(54) REFRIGERANT SYSTEM AND CONTROLLING METHOD THEREOF FOR EQUALIZING PRESSURE DIFFERENCE BETWEEN OIL SEPARATOR AND EVAPORATOR

(71) Applicant: Fu Sheng Industrial Co. Ltd., Taipei City (TW)

(72) Inventors: Wei-Hsu Lin, New Taipei City (TW); Yao-Chung Yu, New Taipei City (TW); Xuan-Fu Li, New Taipei City (TW); Yu-Chih Chen, New Taipei City (TW)

(73) Assignee: Fu Sheng Industrial Co. Ltd., Taipei City (TW)

( * ) Notice: Subject to any disclaimer, the term of this patent is extended or adjusted under 35 U.S.C. 154(b) by 80 days.

(21) Appl. No.: 18/661,742

(22) Filed: May 13, 2024

(65) Prior Publication Data

US 2024/0426532 A1 Dec. 26, 2024

(30) Foreign Application Priority Data

Jun. 21, 2023 (TW) ..... 112123510

(51) Int. Cl.
*F25B 31/00* (2006.01)
*F25B 43/00* (2006.01)
*F25B 49/02* (2006.01)

(52) U.S. Cl.
CPC ..... *F25B 49/022* (2013.01); *F25B 31/004* (2013.01); *F25B 43/003* (2013.01); (Continued)

(58) Field of Classification Search
CPC .. F25B 41/24; F25B 43/003; F25B 2339/047; F25B 2400/04; F25B 2400/0401; (Continued)

(56) References Cited

U.S. PATENT DOCUMENTS 4,419,865 A * 12/1983 Szymaszek ..... F04C 11/003 62/193
6,058,727 A * 5/2000 Fraser, Jr. ..... F25B 43/006 62/190

(Continued)

FOREIGN PATENT DOCUMENTS

CN 103175344 4/2015
CN 104697233 6/2015

(Continued)

OTHER PUBLICATIONS

"Search Report of Europe Counterpart Application", issued on Nov. 6, 2024, p. 1-p. 10.

*Primary Examiner* — Jerry-Daryl Fletcher
*Assistant Examiner* — Daniel C Comings
(74) *Attorney, Agent, or Firm* — JCIPRNET

(57) ABSTRACT

A refrigerant system including a compressor, an oil separator, an oil solenoid valve, a condenser, an evaporator, a bypass pipe, and a bypass solenoid valve is disclosed. The oil separator is connected to an output end of the compressor. The oil solenoid valve is disposed between the oil cooler and the compressor. The condenser is connected to the oil separator. The evaporator is connected to the condenser. The bypass pipe has a first end and a second end opposite to the first end. The first end is connected between the oil separator and the condenser, and the second end is connected between the evaporator and an input end of the compressor. The bypass solenoid valve is disposed on the bypass pipe. A controlling method for the refrigerant system is also disclosed.

12 Claims, 3 Drawing Sheets

(52) U.S. Cl.
CPC ..... *F25B 2400/13* (2013.01); *F25B 2500/16* (2013.01); *F25B 2500/26* (2013.01); *F25B 2600/2507* (2013.01); *F25B 2700/197* (2013.01)

(58) Field of Classification Search
CPC ..... F25B 2400/0403; F25B 2400/0409; F25B 31/002; F25B 31/004; F25B 2313/004; F25B 2500/16; F25B 2500/26
See application file for complete search history.

(56) References Cited

U.S. PATENT DOCUMENTS

| | | | | |
|---|---|---|---|---|
| 6,122,924 | A * | 9/2000 | Lifson | F04B 49/24 62/196.3 |
| 7,028,491 | B2 | 4/2006 | Horton | |
| 2005/0028552 | A1* | 2/2005 | Nishijima | F25B 31/004 62/470 |
| 2015/0337831 | A1 | 11/2015 | Zhou et al. | |
| 2017/0074551 | A1* | 3/2017 | Kurata | F25B 31/004 |
| 2017/0198696 | A1 | 7/2017 | Ignatiev et al. | |
| 2019/0310005 | A1* | 10/2019 | Cluff | F25B 31/026 |
| 2021/0063057 | A1* | 3/2021 | Vause | F04D 27/0276 |
| 2022/0275984 | A1* | 9/2022 | Yamada | F25B 41/20 |

FOREIGN PATENT DOCUMENTS

| | | | | |
|---|---|---|---|---|
| CN | 105180491 | | 12/2015 | |
| CN | 108954914 | A * | 12/2018 | F25B 41/30 |
| CN | 215216748 | | 12/2021 | |
| EP | 3290825 | | 5/2021 | |
| GB | 2553972 | A * | 3/2018 | F25B 49/02 |
| JP | 5521924 | | 6/2014 | |
| TW | M501543 | | 5/2015 | |
| TW | M636581 | | 1/2023 | |
| TW | M649582 | | 12/2023 | |
| WO | 2018097154 | | 5/2018 | |

* cited by examiner

REFRIGERANT SYSTEM AND CONTROLLING METHOD THEREOF FOR EQUALIZING PRESSURE DIFFERENCE BETWEEN OIL SEPARATOR AND EVAPORATOR

CROSS-REFERENCE TO RELATED APPLICATION

This application claims the priority benefit of Taiwan application serial no. 112123510, filed on Jun. 21, 2023. The entirety of the above-mentioned patent application is hereby incorporated by reference herein and made a part of this specification.

BACKGROUND

Technical Field

The disclosure relates to a refrigerant system, and in particular to a refrigerant system and a controlling method thereof.

Description of Related Art

In the refrigerant system, the compressor extracts the low-pressure gaseous refrigerant from the evaporator and compresses the low-pressure gaseous refrigerant into high-pressure gaseous refrigerant, which is then transported to the condenser. The high-pressure gaseous refrigerant is exothermic in the condenser to form high-pressure liquid refrigerant. Next, the high-pressure liquid refrigerant flows through the expansion valve and is depressurized to a low-pressure liquid refrigerant. Then, the low-pressure liquid refrigerant flows into the evaporator and absorbs heat in the evaporator to form low-pressure gaseous refrigerant to complete the refrigerant cycle.

Specifically, the high-pressure gaseous refrigerant from the compressor to the condenser is accompanied by lubricating oil. The high-pressure gaseous refrigerant and the lubricating oil are first transported to the oil separator, which separates the high-pressure gaseous refrigerant and the lubricating oil, and then the high-pressure gaseous refrigerant is sent to the condenser. As a result, the oil separator is under high pressure and generates a huge pressure difference with the input side of the compressor, which causes the compressor to be subjected to a huge load after shutdown and restart, which not only easily leads to the damage of the internal parts (such as motors, bearings, or other components), but also leads to a decline in the operating efficiency of the compressor and an increase in the energy consumption.

SUMMARY

The disclosure provides a refrigerant system and a control method thereof, capable of reducing a start-up load of a compressor and preventing bearing damage caused by unsmooth lubrication during start-up of the compressor.

The disclosure proposes a refrigerant system, including a compressor, an oil separator, an oil solenoid valve, a condenser, an evaporator, a bypass pipe, and a bypass solenoid valve. The compressor has an input end and an output end opposite to the input end. The oil separator is connected to the output end of the compressor and is configured to supply lubricating oil before the compressor starts. The oil solenoid valve is disposed between the oil separator and the compressor. The condenser is connected to the oil separator. The evaporator is connected to the condenser. The bypass pipe has a first end and a second end opposite to the first end. The first end is connected between the oil separator and the condenser, and the second end is connected between the evaporator and the input end of the compressor. The bypass solenoid valve is disposed on the bypass pipe to equalize a pressure difference between the oil separator and the evaporator.

In an embodiment of the disclosure, the refrigerant system further includes a first check valve and a second check valve. The first check valve is disposed between the output end of the compressor and the oil separator. The second check valve is disposed between the oil separator and the condenser, and the first end of the bypass pipe is connected between the oil separator and the second check valve.

In an embodiment of the disclosure, the refrigerant system further includes a water tower and a water pump. The water tower is connected to a water outlet of the condenser, and the water tower is equipped with a fan. The radiator tower is connected to a water inlet of the condenser through the water pump.

In an embodiment of the disclosure, the refrigerant system further includes a liquid pipe solenoid valve. The liquid pipe solenoid valve is disposed between the condenser and the evaporator and is configured to shut down before the compressor shuts down.

In an embodiment of the disclosure, the refrigerant system further includes an expansion valve disposed between the liquid pipe solenoid valve and the evaporator.

In an embodiment of the disclosure, the refrigerant system further includes an oil cooler, an economizer, and a liquid-gas separator. The oil cooler is connected between the compressor and the oil separator. The economizer is connected to the condenser. The liquid-gas separator is connected between the evaporator and the input end of the compressor.

In an embodiment of the disclosure, the refrigerant system further includes a filter dryer connected between the condenser and the economizer.

The disclosure proposes a controlling method of a refrigerant system, including the following. A startup signal is received. A water pump and a fan of a water tower are started. A pressure difference between an oil separator and an evaporator is determined. If the pressure difference is greater than a pressure difference setting value, a bypass solenoid valve is opened to equalize the pressure difference between the oil separator and the evaporator. If the pressure difference is less than or equal to the pressure difference setting value, an oil solenoid valve is opened to supply lubricating oil before the compressor starts. After the oil solenoid valve has been open for a first set time, the compressor is started. After the compressor has started for a second set time, the bypass solenoid valve is closed.

In an embodiment of the disclosure, at the opening of the solenoid valve, countdown is from the first set time, and at the end of the countdown, the compressor is started.

In an embodiment of the disclosure, at the starting of the compressor, countdown is from the second set time, and at the end of the countdown, the bypass solenoid valve is closed.

In an embodiment of the disclosure, the controlling method of the refrigerant system further includes the following. A shutdown signal is received. A liquid pipe solenoid valve is closed to reduce pressure of the evaporator. The pressure of the evaporator is detected. If the pressure of the evaporator is less than or equal to a pressure setting value, the compressor is shut down. If the pressure of the evaporator is greater than the pressure setting value, the compressor is shut down after a third set time.

In an embodiment of the disclosure, at the closing of the liquid pipe solenoid valve, countdown is from the third set time, and if the pressure of the evaporator is greater than the pressure setting value, the compressor is shut down at the end of the countdown.

Based on the above, the refrigerant system and the controlling method thereof of the disclosure may equalize the pressure difference between the oil separator and the evaporator by opening the bypass solenoid valve to reduce the start-up load of the compressor, which not only helps to improve the operating efficiency, but also reduces the energy consumption for the purpose of environmental protection and energy saving. In addition, after the pressure difference between the oil separator and the evaporator is less than or equal to the pressure difference setting value, the oil separator may supply lubricating oil to the compressor before starting to lubricate the internal bearing of the compressor, and then start the compressor. Pre-lubricated bearings help to reduce the running resistance of the compressor after start-up, which not only prevents damage to internal parts (such as motors, bearings or other components), but also helps to increase operating efficiency.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate example embodiments of the disclosure and, together with the description, serve to explain the principles of the disclosure.

DESCRIPTION OF THE EMBODIMENTS

Figure 1:
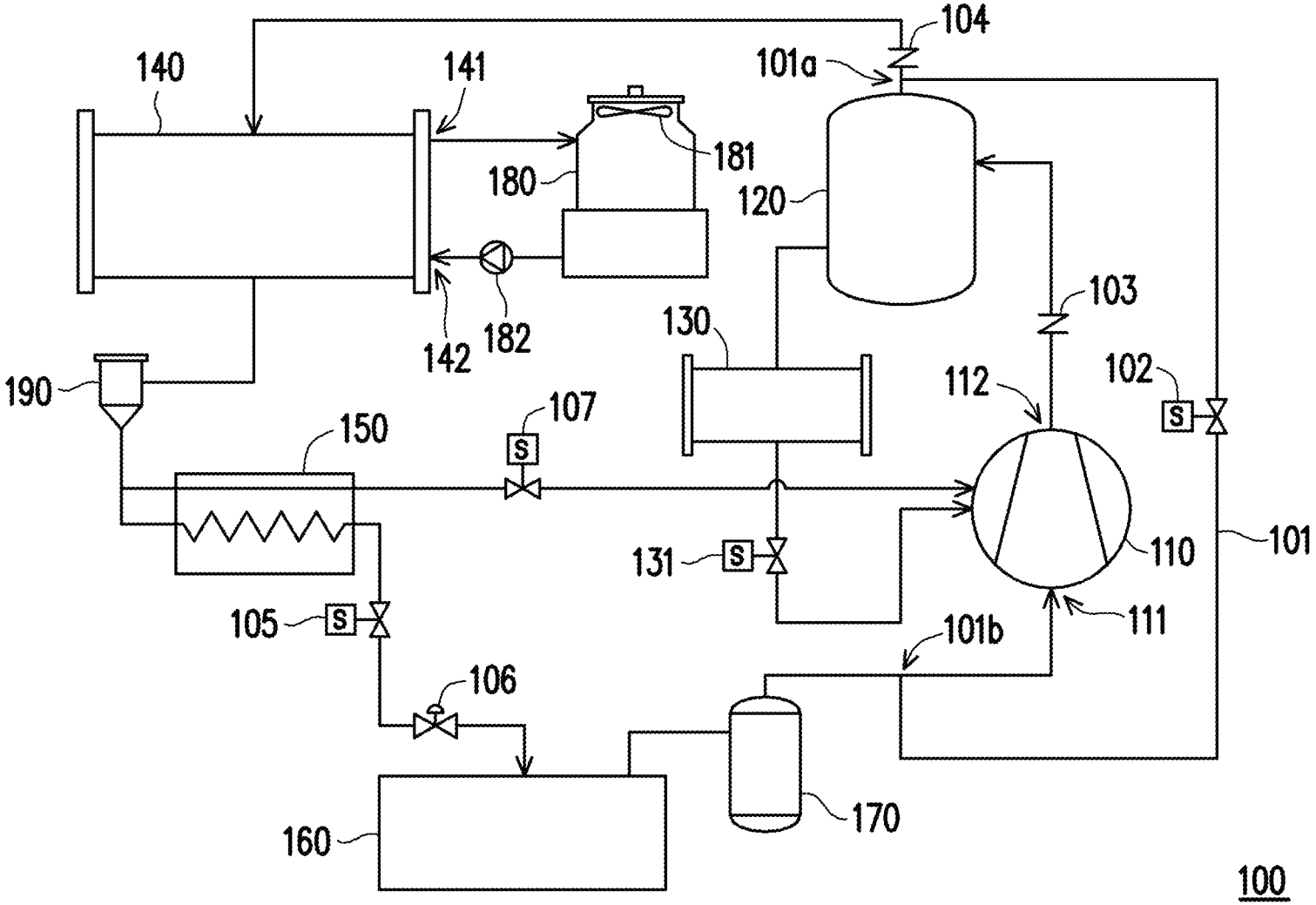
FIG. 1 is a schematic structural diagram of a refrigerant system according to an embodiment of the disclosure.

FIG. 1 is a schematic structural diagram of a refrigerant system according to an embodiment of the disclosure. Referring to FIG. 1, in this embodiment, a refrigerant system 100 includes a compressor 110, an oil separator 120, an oil cooler 130, an oil solenoid valve 131, a condenser 140, an economizer 150, an evaporator 160, a liquid-gas separator 170, a bypass pipe 101, and a bypass solenoid valve 102. For example, the compressor 110 may be a single-stage compressor or a two-stage compressor, and the disclosure is not limited thereto.

Specifically, the oil separator 120 is configured to supply lubricating oil to the compressor 110, and the compressor 110 has an input end 111 and an output end 112 opposite to the input end 111. The oil separator 120 is connected to the output end 112 of the compressor 110, and the oil separator 120 and the output end 112 of the compressor 110 are located at a high-pressure side of the system. On the other hand, the oil cooler 130 is connected between the compressor 110 and the oil separator 120 for cooling the lubricating oil supplied by the oil separator 120 and supplying the cooled lubricating oil to the compressor 110.

As shown in FIG. 1, the oil solenoid valve 131 is disposed between the oil separator 120 and the compressor 110 to stop lubricating oil supply to the compressor 110 by closing the oil solenoid valve 131 and, correspondingly, to supply lubricating oil to the compressor 110 by opening the oil solenoid valve 131. Furthermore, the oil solenoid valve 131 is disposed between the oil cooler 130 and the compressor 110 to stop the supply of cooled lubricating oil to the compressor 110 by closing the oil solenoid valve 131.

The condenser 140 is connected to the oil separator 120. The condenser 140 has a water outlet 141 and a water inlet 142, and a water tower 180 is connected to the water outlet 141 to receive water from the condenser 140. In addition, the water tower 180 is equipped with a fan 181, and the water tower 180 is connected to the water inlet 142 through the water pump 182 to send the cooled water to the condenser 140 to carry away the heat of the high-temperature refrigerant in the condenser 140, and then discharge the water with the elevated temperature through the water outlet 141, and then circulates in sequence.

Referring to FIG. 1, in this embodiment, the evaporator 160 is connected to the condenser 140, and the economizer 150 is connected between the condenser 140 and the evaporator 160. Furthermore, the refrigerant system 100 further includes a filter dryer 190, a liquid pipe solenoid valve 105, and an expansion valve 106, and the filter dryer 190 is connected between the condenser 140 and the economizer 150. In addition, the liquid pipe solenoid valve 105 is disposed between the condenser 140 and the evaporator 160, specifically between the economizer 150 and the evaporator 160, and the expansion valve 106 is disposed between the liquid pipe solenoid valve 105 and the evaporator 160. The liquid pipe solenoid valve 105 is closed to stop sending the liquid refrigerant to the evaporator 160, and conversely, the liquid pipe solenoid valve 105 is opened to send the liquid refrigerant to the evaporator 160.

The liquid-gas separator 170 is connected between the evaporator 160 and the input end 111 of the compressor 110. The evaporator 160, the liquid-gas separator 170, and the input end 111 of the compressor 110 are located at a low-pressure side of the system, and the pressure of the evaporator 160, the liquid-gas separator 170, and the input end 111 of the compressor 110 is substantially equal. On the other hand, the bypass pipe 101 is connected between the high-pressure side and the low-pressure side of the system. Specifically, the bypass pipe 101 has a first end 101*a* and a second end 101*b* opposite to the first end 101*a*. The first end 101*a* is connected to the high-pressure side, and the second end 101*b* is connected to the low-pressure side. More specifically, the first end 101*a* of the bypass pipe 101 is connected between the oil separator 120 and the condenser 140, and the second end 101*b* is connected between the evaporator 160 and the input end 111 of the compressor 110, specifically between the liquid-gas separator 170 and the input end 111 of compressor 110.

In this embodiment, the bypass solenoid valve 102 is disposed on the bypass pipe 101 and is located between the first end 101*a* and the second end 101*b*. When the bypass solenoid valve 102 is closed, the pressure of the gaseous refrigerant in the oil separator 120 may not be released from the high-pressure side to the low-pressure side. Conversely, when the bypass solenoid valve 102 is opened, the pressure of the gaseous refrigerant may be released from the high-pressure side to the low-pressure side. In other words, when the bypass solenoid valve 102 is closed, the pressure of the gaseous refrigerant in the oil separator 120 may not be released from the oil separator 120 to the evaporator 160 through the bypass pipe 101. Conversely, when the bypass solenoid valve 102 is opened, the pressure of the gaseous refrigerant may be released from the oil separator 120 to the evaporator 160 through the bypass pipe 101 for bypass pressure relief. That is, the combination of the bypass pipe 101 and the bypass solenoid valve 102 may be used to control the pressure difference between the high-pressure side and the low-pressure side of the system, such as the pressure difference between the oil separator 120 and the evaporator 160.

Referring to FIG. 1, the refrigerant system 100 further includes a first check valve 103 and a second check valve 104. The first check valve 103 is disposed between the output end 112 of the compressor 110 and the oil separator 120, and the second check valve 104 is disposed between the oil separator 120 and the condenser 140. Specifically, the first check valve 103 may be used to prevent the high-pressure gaseous refrigerant and lubricating oil from flowing back to the compressor 110. In other words, the first check valve 103 may be used to prevent the refrigerant pressure in the oil separator 120 from flowing back to the compressor 110 when the system is shut down, avoiding any impact on the pressure in the compressor 110 and the evaporator 160.

On the other hand, the first end 101*a* of the bypass pipe 101 is connected between the oil separator 120 and the second check valve 104, and the second check valve 104 may be used to prevent the high-pressure gaseous refrigerant from flowing back from the condenser 140 to the oil separator 120 and the bypass pipe 101. In other words, the second check valve 104 may be used to prevent the refrigerant pressure in the condenser 140 from flowing back to the oil separator 120 and the bypass pipe 101 during bypass pressure relief to avoid affecting the effectiveness of the bypass pressure relief.

As shown in FIG. 1, the refrigerant system 100 further includes an air supply solenoid valve 107. The economizer 150 is connected to the compressor 110 through an air supply pipeline, and the air supply solenoid valve 107 is disposed on the air supply pipeline. When the compressor 110 is in operation or at full load, the air supply solenoid valve 107 may be opened to allow gaseous refrigerant to be sent into the compressor 110 through the air supply pipeline.

Figure 2:
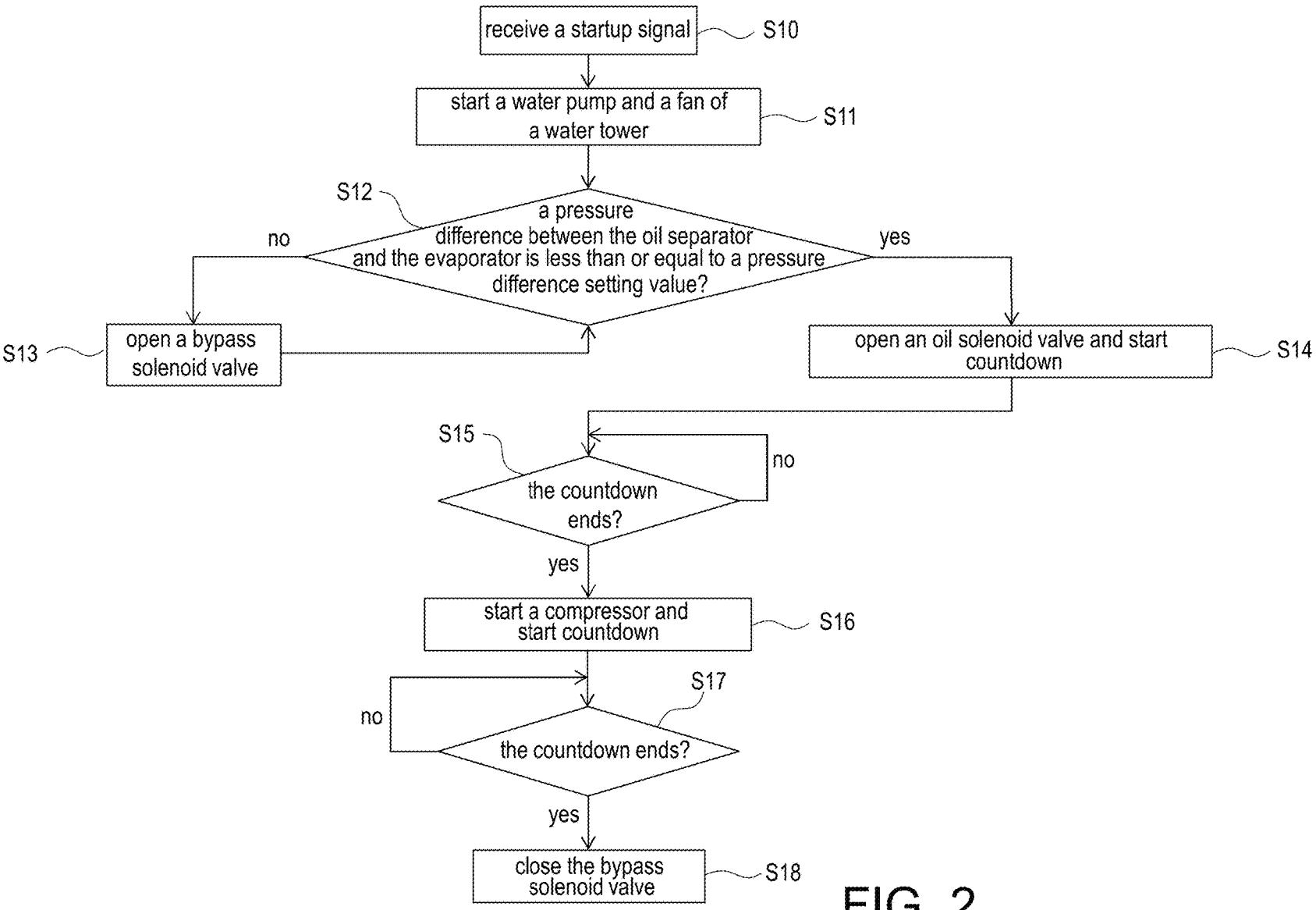
FIG. 2 is a schematic diagram of a startup process of a compressor of a refrigerant system according to an embodiment of the disclosure.

FIG. 2 is a schematic diagram of a startup process of a compressor of a refrigerant system according to an embodiment of the disclosure. Referring to FIG. 1 and FIG. 2, a controlling method of the refrigerant system 100 is explained as follows. In steps S10 to S12, when the refrigerant system 100 receives a startup signal, the water pump 182 and the fan 181 of the water tower 180 are first started, and then a pressure difference between the oil separator 120 and the evaporator 160 is determined.

In steps S12 and S13, whether the pressure difference between the oil separator 120 and the evaporator 160 is less than or equal to a pressure difference setting value is determined. If the pressure difference between the oil separator 120 and the evaporator 160 is greater than the pressure difference setting value (for example, 2 to 2.5 kg/cm$^2$), the bypass solenoid valve 102 is opened to equalize the pressure between the oil separator 120 and the evaporator 160 (or the liquid-gas separator 170). That is, before the compressor 110 starts, if the pressure difference between the oil separator 120 and the evaporator 160 is too large, the bypass solenoid valve 102 is opened so that the pressure may be released from the oil separator 120 to the evaporator 160 (or the liquid-gas separator 170) to reduce the start-up load of the compressor 110, which not only helps to improve the operating efficiency, but also reduces the energy consumption for the purpose of environmental protection and energy saving.

If the pressure difference between the oil separator 120 and the evaporator 160 is less than or equal to the pressure difference setting value, the oil solenoid valve 131 is opened to supply lubricating oil to the compressor 110 before the compressor 110 starts. At this time, the bypass solenoid valve 102 is still open to continue pressure relief. In steps S14 to S16, when the oil solenoid valve 131 is opened, a countdown starts from a first set time (for example, 1 to 2 seconds), and when the countdown ends, the compressor 110 is started. That is, after the oil solenoid valve 131 opens and supplies lubricating oil to the compressor 110 for the first set time, the fully pre-lubricated compressor 110 is started.

Specifically, after the pressure difference of the oil separator 120 and the evaporator 160 is less than or equal to the pressure difference setting value, the oil separator 120 first supplies lubricating oil to the compressor 110 before starting to lubricate the bearings inside the compressor 110, and then starts the compressor 110. Pre-lubricated bearings help to reduce the running resistance of the compressor 110 after start-up, which not only prevents damage to internal parts (such as motors, bearings or other components), but also helps to increase operating efficiency.

Please continue to refer to FIG. 1 and FIG. 2. In steps S16 to step S18, when the compressor 110 is started, the countdown starts from a second set time (for example, 5 to 6 seconds). When the countdown ends, the bypass solenoid valve 102 is closed to stop pressure relief. That is, the bypass solenoid valve 102 is closed only after the compressor 110 is started for the second set time. In the early stage after the compressor 110 is started (i.e., within the second set time), the bypass solenoid valve 102 is continuously opened to relieve pressure to reduce the pressure difference, thereby achieving the purpose of reducing the start-up load.

Figure 3:
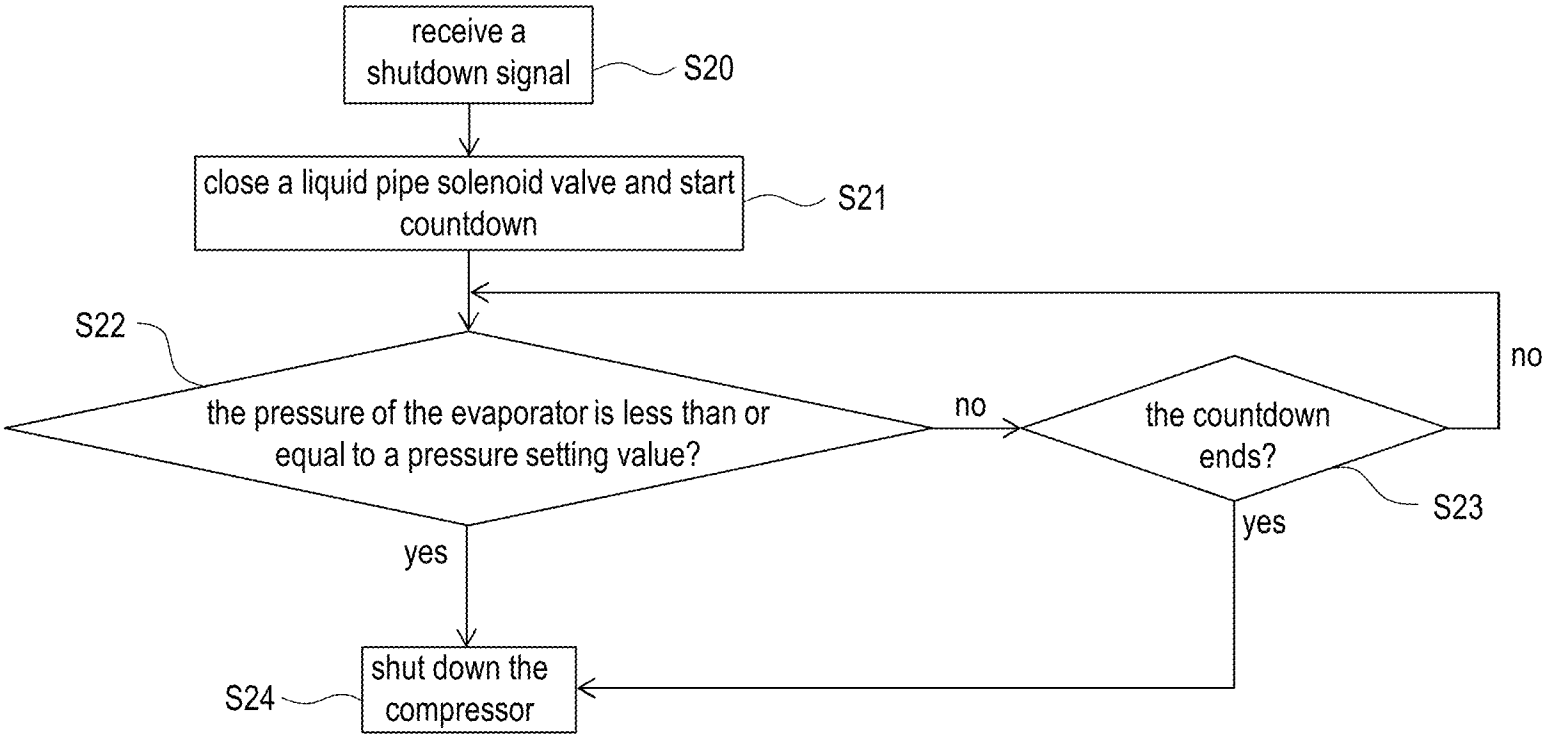
FIG. 3 is a schematic diagram of a shutdown process of a compressor of a refrigerant system according to an embodiment of the disclosure.

FIG. 3 is a schematic diagram of a shutdown process of a compressor of a refrigerant system according to an embodiment of the disclosure. Referring to FIG. 1 and FIG. 3, the controlling method of the refrigerant system 100 is explained as follows. In steps S20 to S22, when the refrigerant system 100 receives a shutdown signal, the liquid pipe solenoid valve 105 is first closed to stop sending the liquid refrigerant to the evaporator 160 and the liquid-gas separator 170. At this time, the compressor 110 continues to operate, discharging the refrigerant from the evaporator 160 and the compressor 110 to reduce the pressure of the evaporator 160. Then, the pressure of the evaporator 160 is detected and whether the pressure of the evaporator 160 (or the liquid-gas separator 170) is less than or equal to the pressure setting value is determined. In addition, when the liquid pipe solenoid valve 105 is closed, the countdown starts from a third set time (for example, 30 to 60 seconds).

In steps S22 to S24, if the pressure of the evaporator 160 is less than or equal to the pressure setting value, the compressor 110 is directly shut down. If the pressure of the evaporator 160 (or the liquid-gas separator 170) is greater than the pressure setting value, the compressor 110 continues to operate, discharging the gaseous refrigerant from the evaporator 160 and the compressor 110 to reduce the refrigerant pressure in both of them, and in the process of counting down, the pressure of the evaporator 160 is continuously judged to determine whether to directly shut down the compressor 110 or to shut it down at the end of the countdown. That is, before shutting down the compressor 110, if the pressure of the evaporator 160 is greater than the pressure setting value, the compressor 110, which may continue to operate for up to a third set time after closing the liquid pipe solenoid valve 105, may extract the low-pressure gaseous refrigerant from the liquid-gas separator 170, resulting in a lowering of the pressure of the evaporator 160.

Before the compressor 110 is shut down, the liquid refrigerant has stopped being sent from the condenser 140 to the evaporator 160 and the liquid-gas separator 170, which greatly reduces the pressure of the evaporator 160, and its gauge pressure is approximately equal to 0 kg/cm$^2$. Since the pressure of the evaporator 160 drops to an extremely low level and the refrigerant is centrally stored in the condenser 140, the pressure difference between the oil separator 120 and the evaporator 160 increases, which not only helps to speed up the process of equalizing the pressure difference between the oil separator 120 and the evaporator 160, but also helps to reduce the average value of the pressure of the oil separator 120 and the pressure of the evaporator 160.

Referring to FIG. 1 and FIG. 2, after the refrigerant system 100 receives the startup signal, it must first determine the pressure difference between the high-pressure side and the low-pressure side, specifically the pressure difference between the oil separator 120 and the evaporator 160. When the pressure difference does not meet a set condition, the bypass solenoid valve 102 is opened to release the pressure from the high-pressure side to the low-pressure side. Specifically, the pressure is released from the oil separator 120 to the evaporator 160 so that the pressure difference meets the set condition. Once the pressure difference meets the set condition, the oil solenoid valve 131 is opened to lubricate the bearings of the compressor 110 and/or the compression chamber. After the bearings of the compressor 110 have been lubricated for a period of time, the compressor 110 is started, so that the lubricating oil is injected into the compressor 110 before and after starting to reduce the loss of the bearings.

Referring to FIG. 1 and FIG. 3, after the refrigerant system 100 receives the shutdown signal, the liquid pipe solenoid valve 105 is directly closed, and the pressure of the evaporator 160 within a period of time is determined. Once the pressure of the evaporator 160 meets the set conditions, the compressor 110 is directly shut down. Conversely, once the pressure of the evaporator 160 does not meet the set condition, the compressor 110 continues to operate during this period of time to reduce the pressure of the evaporator 160, and continues to determine the pressure of the evaporator 160, or at the end of this period of time, the compressor 110 stops operating.

Referring to FIG. 1 and FIG. 3, before the compressor 110 stops operating, the liquid pipe solenoid valve 105 is closed to stop sending the refrigerant from the condenser 140 to the evaporator 160, the liquid-gas separator 170, and the compressor 110. At this time, the compressor 110 continues to discharge the refrigerant at the low-pressure side to the oil separator 120 and the condenser 140, so that the refrigerant pressure in the evaporator 160, the liquid-gas separator 170, and the compressor 110 is reduced.

Correspondingly, after the compressor 110 stops operating, the first check valve 103 may prevent the refrigerant pressure in the oil separator 120 from flowing back to the compressor 110, so that the evaporator 160, the liquid-gas separator 170, and the compressor 110 may maintain relative low pressure when they stop operating. Thus, when the compressor 110 is started again, since the average pressure of the evaporator 160 and the oil separator 120 is low, the start-up load of the compressor 110 is relatively low to reduce the load on the components of the compressor 110. On the other hand, since the average pressure between the evaporator 160 and the oil separator 120 is low, when the compressor 110 is started, the refrigerant may easily overtop the first check valve 103 so that the gas inside the compressor 110 may be discharged smoothly.

In addition, due to the higher pressure difference between the oil separator 120 and the compressor 110, the bypass effect is better when opening the bypass solenoid valve 102 to relieve the refrigerant pressure from the high-pressure side to the low-pressure side, and there is enough pressure difference to drive the lubricating oil from the oil separator 120 to smoothly inject into the compressor 110 before the compressor 110 starts to achieve the purpose of pre-lubrication of the bearings before the start of the compressor 110, which not only reduces the resistance of the parts to start, but also avoids damage to the bearings.

To sum up, the refrigerant system and the controlling method thereof of the disclosure may equalize the pressure difference between the oil separator and the evaporator by opening the bypass solenoid valve to reduce the start-up load of the compressor, which not only helps to improve the operating efficiency, but also reduces the energy consumption for the purpose of environmental protection and energy saving. In addition, after the pressure difference between the oil separator and the evaporator is less than or equal to the pressure difference setting value, the oil separator may supply lubricating oil to the compressor before starting to lubricate the internal bearing of the compressor, and then start the compressor. Pre-lubricated bearings help to reduce the running resistance of the compressor after start-up, which not only prevents damage to internal parts (such as motors, bearings or other components), but also helps to increase operating efficiency.

In addition, before shutting down the compressor, the liquid pipe solenoid valve is closed to stop sending the liquid refrigerant to the evaporator and the liquid-gas separator, and then the refrigerant of the low-pressure side is discharged through the continuous operation of the compressor, resulting in a significant reduction in the pressure of the evaporator. As the evaporator pressure drops to a very low level, the pressure difference between the oil separator and the evaporator increases, allowing the bypass program at the next startup to accelerate the process of equalizing the pressure difference between the oil separator and the evaporator.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A refrigerant system, comprising:

a compressor, having an input end and an output end opposite to the input end;

an oil separator, connected to the output end of the compressor, configured to supply lubricating oil before the compressor starts;

an oil solenoid valve, disposed between the oil separator and the compressor;

a condenser, connected to the oil separator;

an evaporator, connected to the condenser;

a bypass pipe, having a first end and a second end opposite to the first end, wherein the first end is connected between the oil separator and the condenser, and the second end is connected between the evaporator and the input end of the compressor; and a bypass solenoid valve, disposed on the bypass pipe and configured to be opened in response to a pressure difference between the oil separator and the evaporator being greater than a pressure difference setting value to equalize the pressure difference;

the oil solenoid valve is configured to be opened in response to the pressure difference having become less than or equal to the pressure difference setting value to supply lubricating oil from the oil separator to the compressor before the compressor starts;

after the oil solenoid valve has been open for a first set time, the compressor is started;

after the compressor has been started for a second set time, the bypass solenoid valve is closed.

2. The refrigerant system according to claim 1, comprising:

a first check valve, disposed between the output end of the compressor and the oil separator; and a second check valve, disposed between the oil separator and the condenser, and the first end of the bypass pipe connected between the oil separator and the second check valve.

3. The refrigerant system according to claim 1, comprising:

a water tower, connected to a water outlet of the condenser, the water tower equipped with a fan; and a water pump, wherein the water tower is connected to a water inlet of the condenser through the water pump.

4. The refrigerant system according to claim 1, comprising:

a liquid pipe solenoid valve, disposed between the condenser and the evaporator, configured to shut down before the compressor shuts down.

5. The refrigerant system according to claim 4, further comprising:

an expansion valve, disposed between the liquid pipe solenoid valve and the evaporator.

6. The refrigerant system according to claim 1, further comprising:

an oil cooler, connected between the compressor and the oil separator;

an economizer, connected between the condenser and the evaporator; and a liquid-gas separator, connected between the evaporator and the input end of the compressor.

7. The refrigerant system according to claim 6, further comprising:

a filter dryer, connected between the condenser and the economizer.

8. A controlling method of a refrigerant system, comprising:

receiving a startup signal;

starting a water pump and a fan of a water tower;

determining that a pressure difference between an oil separator and an evaporator is greater than a pressure difference setting value;

in response to the determination that the pressure difference is greater than the pressure difference setting value, opening a bypass solenoid valve to equalize the pressure difference between the oil separator and the evaporator;

determining that the pressure difference has become less than or equal to the pressure difference setting value;

in response to the determination that the pressure difference has become less than or equal to the pressure difference setting value, opening an oil solenoid valve to supply lubricating oil from the oil separator to a compressor before the compressor starts;

after the oil solenoid valve has been open for a first set time, starting the compressor; and after the compressor has been started for a second set time, closing the bypass solenoid valve.

9. The controlling method of the refrigerant system according to claim 8, wherein at the opening of the oil solenoid valve, counting down from the first set time, and at the end of the countdown, starting the compressor.

10. The controlling method of the refrigerant system according to claim 8, wherein at the starting of the compressor, counting down from the second set time, and at the end of the countdown, closing the bypass solenoid valve.

11. The controlling method of the refrigerant system according to claim 8, comprising:

receiving a shutdown signal;

closing a liquid pipe solenoid valve to reduce pressure of the evaporator;

detecting the pressure of the evaporator;

in response to the pressure of the evaporator being less than or equal to a pressure setting value, shutting down the compressor; and in response to the pressure of the evaporator being greater than the pressure setting value, shutting down the compressor after a third set time.

12. The controlling method of the refrigerant system according to claim 11, wherein at the closing of the liquid pipe solenoid valve, counting down from the third set time, and if the pressure of the evaporator is greater than the pressure setting value, shutting down the compressor at the end of the countdown.

* * * * *